US006149381A

United States Patent [19]

Lee

[11] Patent Number: 6,149,381

[45] Date of Patent: Nov. 21, 2000

[54] CROSS FLOW FAN FOR AIR CONDITIONER

[75] Inventor: Jai-kwon Lee, Suwon, Rep. of Korea

[73] Assignee: SamSung Electronics Co., Ltd., Suwon, Rep. of Korea

[21] Appl. No.: 09/302,430

[22] Filed: Apr. 30, 1999

[30] Foreign Application Priority Data

Nov. 18, 1998 [KR] Rep. of Korea ..... 98-49614

[51] Int. Cl.[7] ..... F04D 5/00

[52] U.S. Cl. ..... 415/53.1; 415/119; 416/178; 416/187; 416/203

[58] Field of Search ..... 416/178, 187, 416/203, 175, 200 R; 415/53.1, 53.2, 53.3, 119; 165/121, 122, DIG. 309, DIG. 314, DIG. 315

[56] References Cited

FOREIGN PATENT DOCUMENTS

| | | | |
|---|---|---|---|
| 60-166789 | 8/1985 | Japan | 415/119 |
| 60-169698 | 9/1985 | Japan | 416/178 |
| 3-145599 | 6/1991 | Japan | 416/178 |
| 5-195996 | 8/1993 | Japan | 415/119 |
| 5-231378 | 9/1993 | Japan | 415/53.1 |
| 6-129387 | 5/1994 | Japan | 415/119 |

*Primary Examiner*—Christopher Verdier
*Attorney, Agent, or Firm*—Robert E. Bushnell, Esq.

[57] ABSTRACT

A cross flow fan of an air conditioner adapted to attenuate or offset high sound and low sound which are generated during operation of the cross flow fan to thereby minimize noise and to prevent restriction of revolution thereof, the cross flow fan mounted with a plurality of diaphragms 50 partitioned in multi stages and a plurality of blades 51 horizontally disposed among the diaphragms 50 wherein a distance between blades 51 disposed among the diaphragms 50 is differently arranged for respective diaphragms 50.

11 Claims, 5 Drawing Sheets

CROSS FLOW FAN FOR AIR CONDITIONER

CLAIM OF PRIORITY

This application makes reference to, incorporates the same herein and claims all benefits accruing under 35 U.S.C. §119 from my application CROSS FLOW FAN FOR AIR CONDITIONER filed with the Korean Industrial Property Office on Nov. 18, 1998 and there duly assigned Ser. No. 49614/1998.

BACKGROUND OF THE INVENTION

1. Field of the Invention

The present invention relates to a fan, and more particularly to a cross flow fan for an air conditioner.

2. Description of the Prior Art

Generally, a separation type air conditioner is disposed with an indoor unit so designed as to minimally occupy space and to maximally generate an amount of air, and the indoor unit generally uses a horizontally long cross flow fan.

The cross flow fan, as illustrated in FIG. 5, includes a plurality of diaphragms 50, each disposed at a predetermined interval, with a plurality of blades 51 oriented radially from the center of the diaphragms 50 and between the diaphragms 50, where a rotary axle 52 is protrudingly formed through the diaphragms 50. In other words, a plurality of blades 51, each having a predetermined length, are combined among the diaphragms 50 to form a partitioned fan 54 where a plurality of partitioned fans 54 are horizontally stacked and adhered by an ultrasonic fusion method to thereby form a horizontally-long cross flow fan.

However, the distance (d) between the blades 51 generates a noise when the cross flow fan is operated, thereby yielding a tremendous influence, whereas an equal pitch cross flow fan having an equal distance between blades 51, as illustrated in FIG. 6, maintains an equal distance d' among blades 51' peripherally arranged around the rotary axle 52. The noise characteristic of the equal pitch cross flow fan shows a relatively even shape at the 0~1,000 Hz region of the rotary frequency zone of an air conditioner; however the noise forms a sudden peak at around 750 Hz, thereby generating high-pitched noise components such as a whistle sound and the like.

In order to eliminate such high-pitched noise components, a random pitch cross flow fan having a irregular distance between blades 51 has been disclosed, where, as illustrated in FIG. 8, distances among blades 51" are irregularly disposed as d' and d'". The random pitch cross flow fan produces peak values P', as illustrated in FIG. 9, at a relatively low rotary frequency range of 150~250 Hz and at a relatively high rotary frequency of 750 Hz respectively, such that bandwidths of low noise components L having lower decibels (dB) than the peak values P' are widely distributed to thereby generate a low noise on the whole.

In other words, when an air conditioner mounted with an equal pitch blades 51' is operated, an abnormal sound (high sound) is generated at revolution rates beyond the predetermined rate of the cross flow fan, and when an air conditioner provided with random pitch blades 51" is operated, low sound is generated over relatively broad operation ranges.

SUMMARY OF THE INVENTION

However, there is a problem in arrangement of blades at equal distances or at random distances when a cross flow fan is manufactured as mentioned above in that restriction of operation frequency in the cross flow fan occurs in order to reduce or avoid generation of abnormal noise of low sound or high sound, thereby making it difficult to maintain operational control of the air conditioner at an optimal state.

The present invention is accordingly disclosed to solve the aforementioned problems and it is an object of the present invention to provide a cross flow fan of an air conditioner adapted to attenuate or offset high sound and low sound which are generated during operation of a cross flow fan, thereby minimizing noise and preventing restriction of revolution of the cross flow fan.

In accordance with the object of the present invention, there is provided a cross flow fan for an air conditioner, the fan mounted with a plurality of diaphragms partitioned in multiple stages and a plurality of blades horizontally disposed among the diaphragms, wherein the distance between blades disposed among the diaphragms is differently arranged for respective diaphragms.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
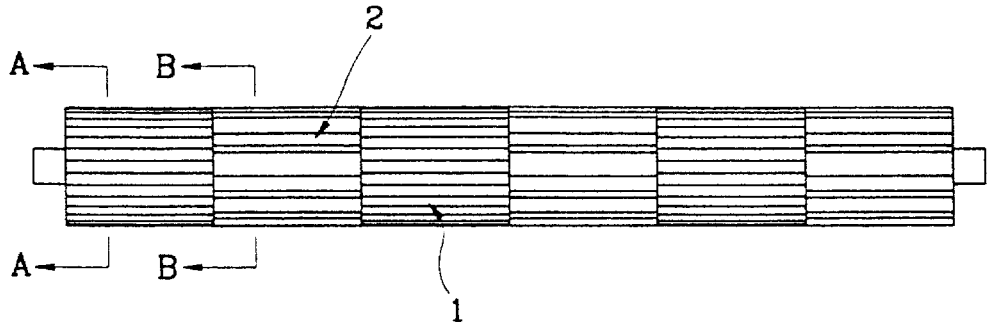
FIG. 1 is a plan view for illustrating a cross flow fan for an air conditioner according to the present invention.
Figure 2:
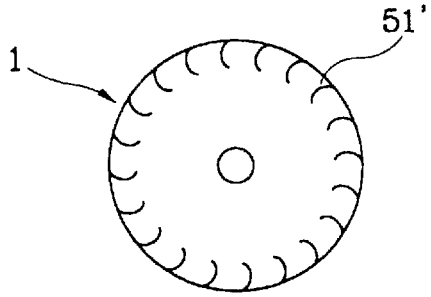
FIG. 2 is a sectional view taken along line A—A in FIG. 1.
Figure 3:
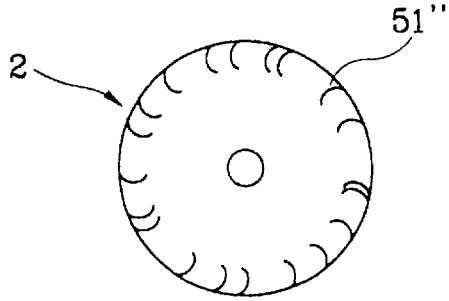
FIG. 3 is a sectional view taken along line B—B in FIG. 1.

FIGS. 1, 2 and 3 are respectively, a plan view for illustrating a cross flow fan according to the present invention, and sectional views taken along line A—A and line B—B in FIG. 1, where a partitioned fan 1 disposed with blades 51' of equal pitch and a partitioned fan 2 arranged with randomly-pitched blades 51" are alternately fused to form a cross flow fan.

In other words, the cross flow fan according to the present invention is designed such that randomly-pitched partitioned fans 2 are positioned among the equally-pitched partitioned fans 1 to thereby reduce abnormal noises by offsetting the high-toned sound generated from the equally-pitched partitioned fans 1 by the low-toned sound occurring at the randomly-pitched partitioned fans 2.

Arrangement between the equally-pitched partitioned fans 1 and the randomly-pitched partitioned fans 2 can be so constructed as to generate an optimal effect, through experimental optimization.

By way of example, noises that are generated differ according to sizes of the cross flow fan (diameter, length and the like), length of the blade, and thickness of each component, such that the number of equally-pitched partitioned fans 1 and the randomly-pitched partitioned fans 2 can be arbitrarily disposed in the ratio of 5:5, 3:7, 7:3 or the like, or arrangement thereof can be alternating, or the same kind of partitioned fan 1 or 2 may be assembled at one side of the cross flow fan, to thereby obtain a condition where the least abnormal noise is generated.

Now, the operational effect of the present invention thus constructed will be described.

When the cross flow fan is operated, room air is sucked indoors through suction inlet of an indoor unit. The cross flow fan simultaneously sucks and discharges the room air, during which time a relatively low decibel (dB) of noise is generated from the cross flow fan.

Figure 4:
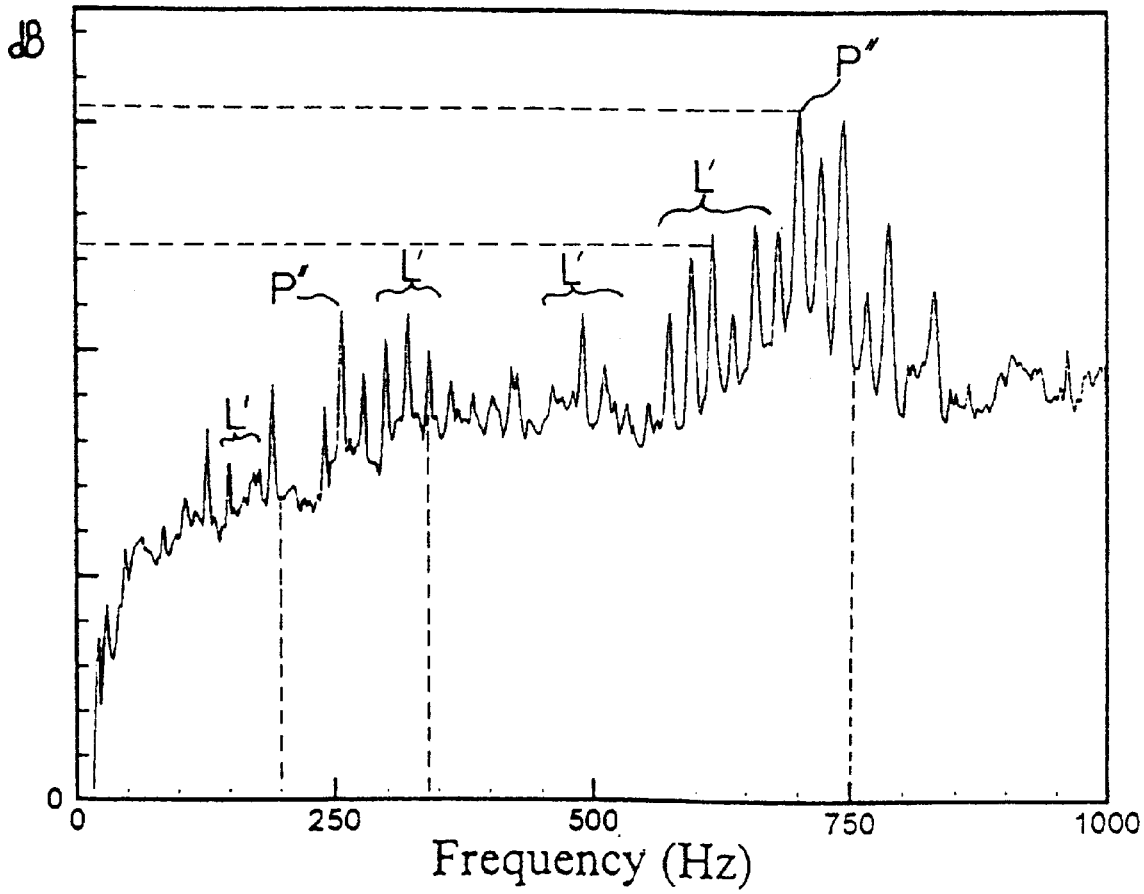
FIG. 4 is a graph for illustrating a noise characteristic according to rotary frequency of a cross flow fan according to the present invention.
Figure 5:
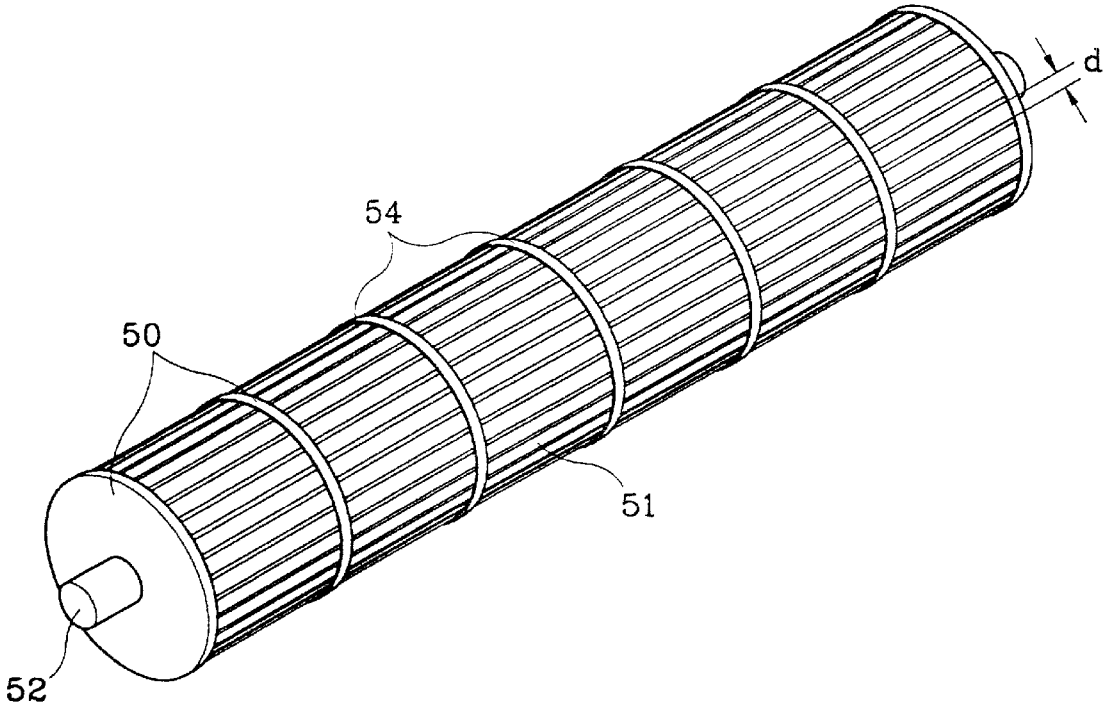
FIG. 5 PRIOR ART
FIG. 5 is a perspective view for illustrating a conventional cross flow fan.
Figure 6:
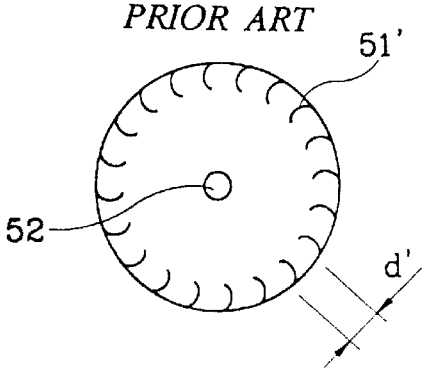
FIG. 6 PRIOR ART
FIG. 6 is a sectional view of a conventional equal pitch cross flow fan having a predetermined equal distance between blades.
Figure 8:
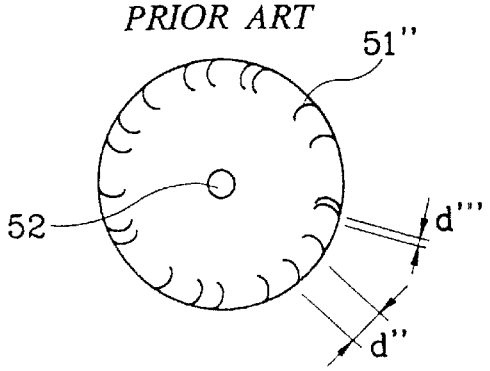
FIG. 8 PRIOR ART
FIG. 8 is a sectional view of a conventional random pitch cross flow fan having an irregular distance between blades.
Figure 7:
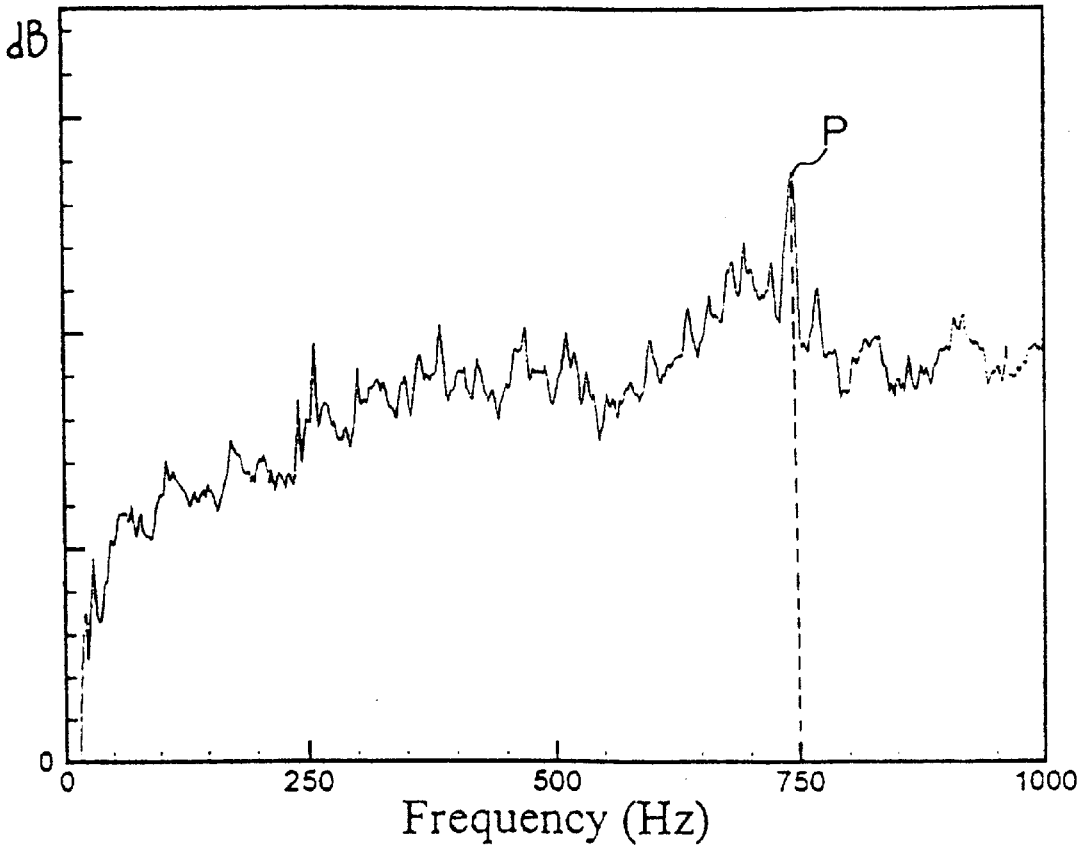
FIG. 7 PRIOR ART
FIG. 7 is a graph for illustrating a noise characteristic according to rotary frequency of an equal pitch cross flow fan according to FIG. 6.
Figure 9:
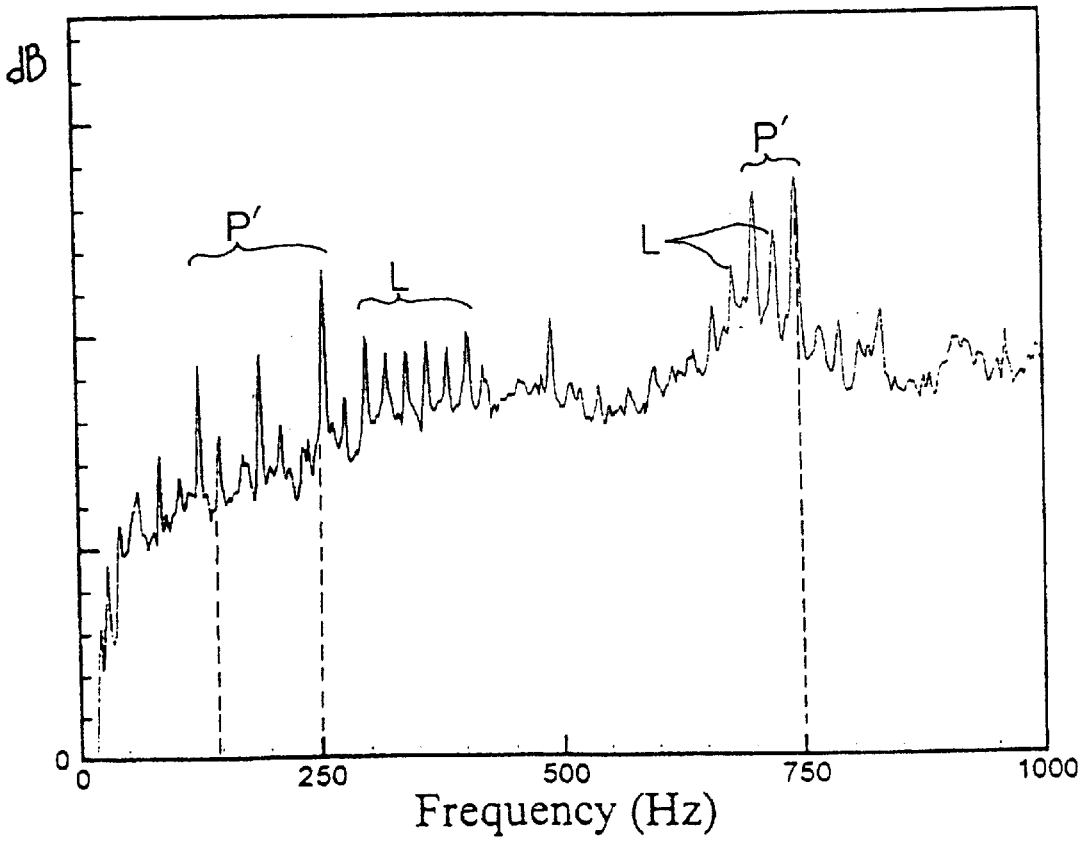
FIG. 9 PRIOR ART
FIG. 9 is a graph for illustrating a noise characteristic according to rotary frequency of a random pitch cross flow fan according to FIG. 8.

In other words, as illustrated in FIG. 4, the abnormal noise is generated at around 250 Hz and 750 Hz where peak values P" and low sound component L' having lower decibels (dB) than the peak values P" are generated. The low sound components L' are evenly generated across the 0~1,000 Hz region while the peak values P" are only generated at about 250 Hz and 750 Hz, such that the peak values P" and the low sound component L' are mutually offset to thereby reduce the overall abnormal noise.

By way of example, when an abnormal noise component of high sound is generated by the above-mentioned peak values P", a relatively low sound component L' of low decibel (dB) is simultaneously generated around the abnormal noise component, such that the high sound of abnormal noise component and low sound of abnormal component are mutually offset to thereby reduce overall abnormal noises.

In other words, the dB height of the low sound component L' is made to stand at around 80% relative to the dB height of the high sound at peak value P" at 100%, thereby maintaining the offset effect of the high and low sound at an optimal state to increase abnormal noise offset effect.

As mentioned above, when the peak values P" and the low sound components L' are offset to attenuate the abnormal noise at an operation region of the indoor unit ranging from zero to 1,000 Hz, the abnormal noise is markedly reduced to provide a user with a further comfortable feeling even though the indoor unit is operated at a high operation state during summer time, causing the rotary frequency to be increased over 750 Hz.

As is apparent from the foregoing, there is an advantage in the cross flow fan for an air conditioner thus constructed in that a partitioned fan mounted with equally pitched blades and a partitioned fan disposed with randomly-pitched blades are alternatively fused to form a cross flow fan to attenuate abnormal noise generated when an indoor unit of the air conditioner is operated.

What is claimed is:

1. An air conditioner, comprising:

an indoor unit, comprising:

a cross-flow fan, said cross-flow fan comprising:

a first partitioned fan having randomly pitched blades; and a second partitioned fan axially fused to said first partitioned fan and separated from said first partitioned fan by a diaphragm, said second partitioned fan having equally pitched blades.

2. The air conditioner of claim 1, said cross-flow fan further comprising:

a third partitioned fan having randomly pitched blades, said third partitioned fan being axially fused to and separated by a second diaphragm from said second partitioned fan, said third partitioned fan being positioned on the opposite side of said second partitioned fan from said first partitioned fan.

3. The air conditioner of claim 1, said cross-flow fan further comprising:

a third partitioned fan having equally pitched blades, said third partitioned fan being axially fused to and separated by a second diaphragm from said first partitioned fan, said third partitioned fan being positioned on the opposite side of said first partitioned fan from said second partitioned fan.

4. The air conditioner of claim 1, said cross-flow fan further comprising:

a plurality of partitioned fans with randomly pitched blades; and a plurality of partitioned fans with equally spaced blades;

said partitioned fans with randomly pitched blades being fused, separated by diaphragms, in an alternating arrangement with said partitioned fans with equally spaced blades.

5. The air conditioner of claim 4, said cross-flow fan further comprising:

the partitioned fans at the two ends of the cross-flow fan each being a randomly spaced blade fan.

6. The air conditioner of claim 4, said cross-flow fan further comprising:

the partitioned fans at the two ends of the cross-flow fan each being an equally spaced blade fan.

7. The air conditioner of claim 1, said cross-flow fan further comprising:

additional partitioned fans with randomly pitched blades; and additional partitioned fans with equally spaced blades;

said additional partitioned fans with randomly pitched blades and said additional partitioned fans with equally spaced blades being axially fused, separated by diaphragms, in a non-alternating arrangement.

8. The air conditioner of claim 7, further comprising:

there being exactly five partition fans with randomly pitched blades and five partition fans with equally pitched blades in said cross-flow fan.

9. The air conditioner of claim 7, further comprising:

there being exactly three partition fans with randomly pitched blades and seven partition fans with equally pitched blades in said cross-flow fan.

10. The air conditioner of claim 7, further comprising:

there being exactly seven partition fans with randomly pitched blades and three partition fans with equally pitched blades in said cross-flow fan.

11. An air conditioner, comprising:

an indoor unit, comprising:

a cross-flow fan, said cross-flow fan comprising:

a plurality of first partitioned fans having randomly pitched blades; and a plurality of second partitioned fans having equally pitched blades;

said partitioned fans with randomly pitched blades being fused, separated by diaphragms, in an alternating arrangement with said partitioned fans with equally spaced blades; and one of the partitioned fans with randomly pitched blades forming one end of the cross-flow fan, and one of the partitioned fans with equally pitched blades forming the other end of the cross-flow fan.

* * * * *